US006957521B2

(12) United States Patent
Botschek et al.

(10) Patent No.: US 6,957,521 B2
(45) Date of Patent: Oct. 25, 2005

(54) ENVELOPE-FILLING STATION FOR MAIL PROCESSING SYSTEMS

(75) Inventors: Christian Botschek, Rodermark (DE); Martin Sting, Bad Vibel (DE)

(73) Assignee: Pitney Bowes Deutschland GmbH, Friedberg Hessen (DE)

( * ) Notice: Subject to any disclaimer, the term of this patent is extended or adjusted under 35 U.S.C. 154(b) by 0 days.

(21) Appl. No.: 10/925,423

(22) Filed: Aug. 25, 2004

(65) Prior Publication Data

US 2005/0072127 A1 Apr. 7, 2005

(51) Int. Cl.[7] ..... B65B 5/04; B65B 25/14
(52) U.S. Cl. ..... 53/284.3; 53/569
(58) Field of Search ..... 53/460, 284.3, 53/569; 271/184, 225

(56) References Cited

U.S. PATENT DOCUMENTS

| | | | | |
|---|---|---|---|---|
| 2,746,221 | A * | 5/1956 | Rouan et al. | 53/460 |
| 3,368,321 | A * | 2/1968 | Sather et al. | 53/569 |
| 5,180,154 | A * | 1/1993 | Malick | 271/184 |
| 5,203,551 | A | 4/1993 | Lowell et al. | |
| 6,102,391 | A * | 8/2000 | Malick et al. | 53/284.3 |
| 6,164,046 | A * | 12/2000 | Werner et al. | 53/569 |
| 6,494,019 | B1 * | 12/2002 | Lingle | 53/247 |
| 6,763,648 | B2 * | 7/2004 | Sting et al. | 53/284.3 |
| 6,789,377 | B2 * | 9/2004 | Sting et al. | 53/569 |
| 2002/0124536 | A1 | 9/2002 | Sting et al. | |

FOREIGN PATENT DOCUMENTS

| | | | |
|---|---|---|---|
| DE | 10220908 C1 | 6/2002 | |
| GB | 2258458 | * 2/1993 | |

* cited by examiner

*Primary Examiner*—John Sipos
(74) *Attorney, Agent, or Firm*—Michael J. Cummings; Charles R. Malandra, Jr.; Angelo N. Chaclas

(57) ABSTRACT

In an envelope-filling station for mail processing systems having an envelope-feeding arrangement for single, open envelopes, an intermediate envelope-conveying arrangement extending at an angle thereto in the direction of an angle stop arrangement provided for the purpose of aligning the envelope, and an envelope-advancing arrangement from which the envelopes are accepted from the angle stop arrangement, a simplification of the design, and effort needed to control the component parts is achieved when the angle stop arrangement, with the exception of a stopping straightedge that is to be provided to achieve extremely precise alignment of an envelope that is supplied at an angle, contains as a further part of the angle stop arrangement a conveying nip between the upper strand of an intermittently driven conveying belt of the envelope-advancing arrangement and a pressure-exerting roller that is pre-tensioned near the beginning of the upper strand of this conveying belt. The envelope-advancing arrangement has coupling means following the pressure-exerting roller that interact with the intermittently driven upper strand of the conveying belt of this envelope-advancing arrangement, in particular a roller bar that can be moved up and down, said means conveying an aligned envelope to a position in front of the feeding station, independent of the function of the pressure-exerting roller, and transporting the filled envelope out of the inserting station.

4 Claims, 1 Drawing Sheet

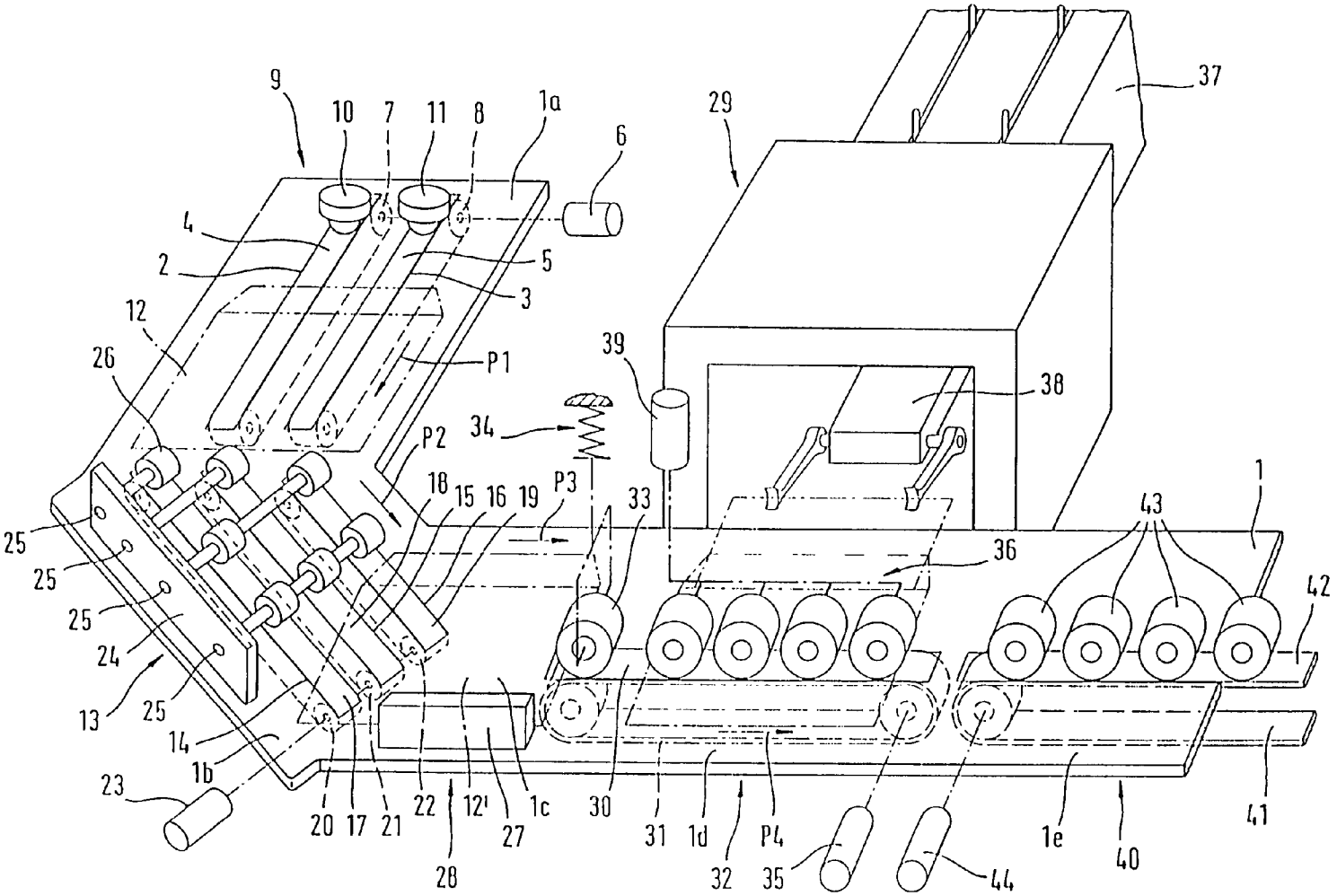
1
1a
1b
1c
1d
1e
2
3
4
5
6
7
8
9
10
11
12
12'
13
14
15
16
17
18
19
20
21
22
23
24
25
26
27
28
29
30
31
32
33
34
35
36
37
38
39
40
41
42
43
44
P1
P2
P3
P4

ENVELOPE-FILLING STATION FOR MAIL PROCESSING SYSTEMS

BACKGROUND OF THE INVENTION

The invention relates to an envelope-filling station for mail processing systems.

An envelope-filling station of this type is disclosed in German patent 10220908 C1. It contains an envelope-conveying device having an envelope-feeding arrangement that extends works essentially in the horizontal plane, approximately in the horizontal plane of the surface of an envelope-filling table, an envelope-conveying arrangement which follows this intermediate envelope-conveying arrangement extending at an angle relative to the conveying direction of the envelope-feeding arrangement, and a following envelope-advancing arrangement, whose conveying direction is horizontally perpendicular to the conveying direction of the envelope-feeding arrangement and is perpendicular to the inserting direction of an intermediate envelope-conveying arrangement that is located next to the enclosure-inserting station.

In the disclosed envelope-filling station, the intermediate envelope-conveying arrangement that is angled relative to the envelope-feeding arrangement and that is angled relative to the envelope-advancing arrangement is dimensioned and located in such a way that the open envelopes are conveyed to a position directly in front of the enclosure inserting station, and there the opened envelopes are aligned precisely in front of the inserting station in conjunction with an angle stop arrangement, whereby an envelope in the feed station is filled with enclosures or enclosure sets and is then transported away by the envelope-advancing arrangement after the angle stop arrangement is switched to an inactive status.

With the prior-art envelope-filling station, if, after a part of the angle stop arrangement is switched to an inactive status, the filled envelope is transferred to the envelope-advancing arrangement, a residual stroke from the inserting arrangement can be used for this transfer. However, if the filled envelope is to be transferred to an envelope-advancing arrangement that is located perpendicular to the insert direction, this transfer must be initiated by the further operation of the angled intermediate envelope-conveying arrangement after the deactivation of the corresponding part of the angle stop apparatus. This can lead to problems when envelopes are filled with a relatively heavy content and when there are unfavorable friction ratios between the upper surface of the envelope-filling table and the lower side of the filled envelope.

Moreover, with the prior-art envelope-filling station it can become difficult in the area of the angled intermediate envelope-conveying arrangement to arrange the conveying belts, which extend at an angle relative to the conveying direction of the envelope-feeding arrangement, and thus the hold-down means that work together with said belts and are embodied as rollers or rolling bodies held in cages, on the envelope-filling table in such a way that an envelope that is to be filled reaches the area in front of the inserting station in complete form, and at the same time remains accessible from above on its path, for example to correct problems.

Finally, it may be desirable to simplify the design of the transition from the intermediate envelope-conveying arrangement to the envelope-advancing arrangement that is perpendicular to the inserting direction of the inserting station.

SUMMARY OF THE INVENTION

Accordingly, the object of the present invention an envelope-filling station that, with a simplification of the construction and of the system controlling the component parts, envelopes are conveyed at a high working speed to a position in front of the enclosure-inserting station and, when there is a comparatively heavy enclosure content, the envelopes can be transferred reliably to an envelope-advancing arrangement that is oriented perpendicular to the inserting direction.

German patent publication 10015756 A1 does disclose an envelope-advancing arrangement in the form of a conveying belt that passes transversely in front of an inserting station and a roller bar that can be moved up and down, and this prior-art envelope-advancing arrangement is also responsible for positioning the open envelope in front of the inserting station and for withdrawing the filled envelope from the inserting station.

However, in the envelope-filling station disclosed here, the pressure-exerting roller that interacts with the top strand of the intermittently driven conveying belt of the envelope-advancing arrangement and is pre-stressed in a downward direction performs a stop function independently of the cyclical control of the coupling means that interact with the upper stand of the conveying belt of the envelope-advancing arrangement, in particular independently of the upward and downward movements of the roller bar, and said stop function does not require a separate control means, which reduces the entire expense required for control.

DESCRIPTION OF THE DRAWING

The invention is explained in greater detail below based on an example of an embodiment, with reference being made to the drawings.

The drawing contains a single FIGURE showing a schematic and perspective view of an envelope-filling station of the type described herein.

DETAILED DESCRIPTION

The drawing shows an L-shaped section of an envelope-filling table 1, which is drawn as a single piece in order to define the working plane of the envelope-filling station. However, in actual embodiments sections of envelope-conveying tables or envelope-filling tables that can be moved relative to each other are provided in a manner that corresponds to the requirements of the individual system components.

The upper strands 4 and 5 of a continuous conveying belt or conveying belts 7 and 8 of an envelope-feeding arrangement 9 that can be placed in motion by a drive 6 extend through the slots 2 and 3 of an envelope-filling table section 1*a*. The upper strands 4 and 5 of the conveying belts 7 and 8 work together with hold-down means in the form of roller bearings 10 and 11 guided in cages. Rows of such rolling bodies may be provided along the length of the conveying belts.

The envelope-feeding arrangement 9 delivers a stream of single, open envelopes in an essentially horizontal plane defined by the envelope-filling table 1, whereby such an envelope is identified as 12 and is depicted in a lying position at the end of the envelope-feeding arrangement 9.

An intermediate envelope-conveying arrangement 13 follows the envelope-feeding arrangement. It grips the leading envelope edge (relative to the conveying direction as shown by arrow P1) of each conveyed envelope, and withdraws the envelope from a region of the envelope-feeding arrangement 9. This area of the envelope-feeding arrangement 9 permits a movement having a component that is transverse to the conveying direction, as indicated by arrow P1, of the envelope-feeding arrangement 9, since such a partial transverse movement of the envelope 12 is not hindered by the hold-down means 10 in the form of roller bodies and the frictional connection between the upper strands 4 and 5 of the conveying belts 7 and 8 and the lower side of the envelope 12 maintains a drive component in the direction of arrow P1 but also permits a transverse component.

The intermediate envelope-conveying arrangement 13 is provided in order to convey the envelope 12 in a translatory movement at an angle of approximately 40° to approximately 60° relative to the conveying direction of the envelope-feeding arrangement 9. For this purpose, slots 14, 15, and 16 are provided in an envelope-filling section 1*b* at an angle corresponding to the aforesaid angle, through which the upper strands 17 and 18, and 19, respectively, of continuous rotating intermediate conveying arrangement conveying belts 20, 21, or 22, respectively, project. The intermediate conveying belts can be set in rotary motion by a drive 23.

Hold-down rollers 26, that are mounted on a support means 24 by means of side-mounted axles 25 and that, deviating from the simplified diagram shown in the drawing, are pre-stressed against the top strands of conveying belts 20, 21, and 22, interact with the intermediate conveying arrangement belts 20, 21, and 22. The rollers that are adjacent to the envelope-feeding arrangement 9 are also pre-stressed against the corresponding conveying belts of the intermediate envelope-conveying arrangement 13 to such an extent that, when the leading edge (relative to the conveying direction of the envelope-feeding arrangement 9) of an envelope 12 reaches the conveying nip between the adjacent hold-down rollers 26 on one side and the upper strands of the conveying belt 20, 21, and 22, the clamping of the envelope between these conveying nips is large enough as a result of the friction connection to the top and bottom of the envelope 12 being conveyed to initiate the aforesaid translatory movement of the envelope 12 and to cause the movement of the envelope in the direction of arrow P2 long the intermediate conveying direction 13 to be continued.

This translatory movement of the envelope 12 in the area of the intermediate envelope-feeding arrangement 13 at an angle of 40 to 60° relative to the conveying direction of the envelope-conveying arrangement 9 corresponding to arrow P1 continues until the previously referred-to leading closed edge of the envelope, which is opposite the envelope opening, strikes a stopping straightedge 27 that is installed in a section 1*c* of the envelope-filling table 1 in an orientation perpendicular to the conveying direction of the envelope-feeding arrangement 9 corresponding to arrow P1, and forms part of the stopping device 28 of the envelope-filling station.

While the precise orientation of the envelope 12 on the path along the envelope-feeding arrangement 9 and the precise orientation of the envelope upon transfer to the intermediate envelope-conveying arrangement 13 are not decisive, so that in these sections of the envelope-filling station additional lateral guides can be eliminated in the interest of simplifying the design and improving the accessibility of the envelope-filling table from above, now, as a result of the aforesaid leading edge of the envelope 12 striking the stopping straightedge 27, the envelope 12 is precisely oriented in a direction in which the aforesaid leading edge extends perpendicular to the conveying direction of the envelope-feeding arrangement as shown by arrow P1 and perpendicular to the inserting direction of an enclosure-inserting station 29, which is described in greater detail below. The envelope 12 gains this orientation after the leading edge strikes the stopping straightedge 27 through continued operation of the conveying belts 20, 21, and 22 of the intermediate envelope-conveying arrangement 13, whereby the upper strands 17, 18, and 19 of these conveying belts now only maintain a low frictional connection to the bottom of the envelope which is being conveyed in the intermediate arrangement, so that in section 1*c* of the envelope-filling table 1 the envelope can perform alignment movements in the plane of the envelope-filling table but, overall, a drive component of the intermediate envelope conveying arrangement 13 continues to be maintained in the direction of arrow P2. Moreover, in the area of the intermediate envelope-conveying arrangement 13 that is not fitted with hold-down rollers 26, hold-down means of the type of the hold-down means 10 and 11 referred to above can interact with the upper strands of the conveying belts 20, 21, and 22, in order to increase the driving effect on the envelope 12 in the direction of the stopping straightedge 27 without hindering envelope movement parallel to the stopping straightedge 27.

The movement of the envelope 12 that was just referred to above in a direction parallel to the stopping straightedge 27 in the direction of arrow P3 continues until the side edge of the envelope 12 that is located next to the envelope opening and that is now the leading edge strikes the additional stopping means that belongs to the stopping device 28, said additional stopping means being formed by the nip between the upper strand of an intermittently operated conveying belt 31 of the envelope-advancing arrangement 32 on one side, and on the other side, by the pressure-exerting roller 33 that is pre-stressed near the beginning of the top strand 30 of the conveying belt. The pre-stressing means for pre-stressing the pressure-exerting roller 33 downwards against the top strand 30 of the conveying belt 31 are shown schematically in the diagram at 34.

When the envelope 12 reaches the angle stopping arrangement comprising the stopping straightedge 27 and the aforesaid nip between the conveying belt 31, which for the time being remains motionless, and the spring-loaded pressure-exerting roller 33, it assumes the position indicated at 12' in the drawing.

If the conveying belt 31 is now caused to turn by a drive 35, while at the same time conveying belts 20, 21, and 22 continue to be turned by appurtenant drive 23, the envelope is pulled from the position indicated at 12' in the precise orientation that was established by stopping straightedge 27, from section 1*c* of the envelope-filling table 1, so that it reaches the area of the envelope-advancing arrangement 32, which has an appurtenant roller bar 36 that can move up and down, said roller bar extending above the conveying belt 31 of the envelope-advancing arrangement 32 in the direction of arrow P4 over the area ahead of the inserting station 29.

The drive 35 for conveying belt 31 of the envelope-transferring arrangement 32 is controlled, possibly in conjunction with optical sensors that respond to the position of the envelope 12, such optical barriers being familiar to persons skilled in the art, in such a way that the envelope reaches a precise position opposite the feeding station 29, after which time the envelope is stopped.

It must be noted that in a non-depicted embodiment, the conveying belt 31 of the envelope-advancing arrangement 32 can also be formed by a perforated vacuum conveying belt that operates in a controllable manner by means of vacuum chambers that can be connected to a vacuum and depending on how the vacuum is applied to the vacuum chambers, the upper strand of the conveying belt establishes a force connection with the lower side of an envelope that is to be advanced. While in the embodiment described above the roller bar that can be moved up and down and that interacting with the upper strand of the conveying belt of the envelope-advancing arrangement forms coupling means, in a modified embodiment of the invention these coupling means are vacuum chambers that interact with the perforated vacuum conveying belt of the envelope-advancing arrangements and can be connected to a vacuum in a controllable manner. The perforated vacuum conveying belt of the envelope-advancing arrangement also interacts in this embodiment, which is not shown, with the pressure-exerting roller, which is pre-tensioned in a downward direction, to perform a stop function.

The inserting station 29 is located at the end of an enclosure collating path 37 that is oriented parallel to the inserting direction of the inserting station 29 and that in a generally known manner has conveying fingers that project over the surface of the collating path and are mounted on rotating chains or belts and that define enclosure conveying trays from which the inserting device 38 of the inserting station 29 takes enclosures or sets of enclosures in order to insert them into the envelope 12, which is held open to receive them. Thus, when an envelope 12 is stopped by the envelope-advancing arrangement 32 at a precise location in front of the inserting station 29, the roller bar is lifted by means of a drive 39, which is represented schematically in the drawing, and the envelope is opened so that the inserting device 38 can insert the enclosure or the set of enclosures into the opened envelope. Then, by means of drive 39 the roller bar 36 is lowered onto the filled envelope and conveying belt 21 is set in motion again by drive 35, and the filled envelope can be transported between the upper strand 30 of the conveying belt 31 from section 1*d* of the envelope-filling table 1 in the direction of an envelope-closing section 40 in the area of section 1*e* of the envelope-filling table 1.

The envelope-closing section 40 contains a continuously revolving conveying belt 41 and a hold-down roller set 43 that interacts with the upper strand of this conveying belt 41 as well as a drive 44 for the movement of conveying belt 41. The details of the envelope-closing section 41 are not included in the scope of the present invention and therefore are not explained in detail. It can be seen that with regard to the up and down movement of the roller bar 36 caused by drive 39, the pressure-exerting roller 33 that is continuously pre-tensioned against the upper strand 30 of conveying belt 31 by the pre-tensioning means 34 does not follow these movements and, as a consequence, the pressure-exerting roller 33 in interacting with the upper strand of the intermittently driven conveying belt 31 remains active as a stopping means of the angle stopping device 28, at least in the operating phases in which the conveying belt 31 of the envelope-advancing arrangement 32 is stopped. Thus, when the conveying belt 31 of the envelope-advancing arrangement 32 is stopped, the roller bar 36 is lifted by drive 39, the envelope 12 that is positioned in front of the inserting station 29 is opened, and an enclosure or set of enclosures is inserted into the opened envelope, and then the roller bar 36 is lowered by drive 39, during this entire time period a subsequent envelope can be supplied by the envelope-feeding arrangement 9, accepted by the intermediate envelope-conveying arrangement 13, and pushed by said intermediate envelope-conveying arrangement 13 against the alignment straightedge 27 to achieve alignment, and finally pushed ahead until the lateral edge of the envelope, which is now the leading edge, strikes the conveying nip between the upper strand 30 of the conveying belt 31 and the pressure-exerting roller 33. If the drive 35 of conveying belt 31 of the envelope-advancing arrangement 32 is put into operation, then the filled envelope is simultaneously transported from section 1*d* of the envelope-filling table 1 to section 1*e* of the envelope-filling table 1, and the aligned envelope, which despite the continued operation of conveying belts 20, 21, 22 is stopped in the stopping device, is conveyed to the position in front of the inserting station 29 corresponding to position 12.

This means that the portion of the angle stop device 28 that is formed by the upper strand 30 and the pressure-exerting roller 33 eliminates the need for separately actuated and separately controlled stopping means and that at the same time different handling can occur taking into account the different friction and weight characteristics of the unfilled envelope and of the filled envelope at the transition from an alignment area corresponding to section 1*c* of the envelope-filling table 1 to an advancing area corresponding to section 1*d* of the envelope-filling table 1.

Of course, instead of the conveying belts of the envelope-feeding arrangement 9 shown in the drawing and of the intermediate envelope-conveying arrangement 13, perforated rotating belts routed across vacuum chambers can also be used, so that by correspondingly setting the vacuum along the direction in which the belt runs, the effective coupling force between the bottom of the envelope and the vacuum conveying belts can be adjusted in such a way that the mobility of the envelope mentioned above is provided at the end of the conveying run of the envelope-feeding arrangement 9 and at the end of the conveying run of the intermediate envelope-conveying arrangement 13 in order to permit the respective translatory movements as indicated by arrow P2 and as indicated by arrow P3.

Furthermore, a person skilled in the art will understand that the envelope-filling station that is merely indicated schematically in the drawing can be configured in such a way with regard to the location of the support means and the position of the stopping straightedge 24 can be designed in such a way that different envelope sizes can be processed. In addition, the support device 24 can be pivoted down or up in order to make the top of the envelope-filling table 1 accessible in the event of malfunctions. The same applies to the roller bar 36 and the sets of rollers 43.

What is claimed is:

1. An envelope-filling station for mail-processing systems, having an envelope-conveying device comprising:

a horizontal envelope-feeding arrangement supplying a stream of separated, open envelopes with a leading closed bottom envelope edge in a direction parallel to an inserting direction of an enclosure-inserting station;

an intermediate envelope-conveying arrangement receiving envelopes from the envelope-feeding arrangement and conveying the envelopes with translatory movement, at an angle in the range of from approximately 40° to 60° relative to the conveying direction of the envelope-feeding arrangement, against an angle stop arrangement which contains a stopping straightedge by means of which, with the intermediate envelope-conveying arrangement still being driven, the leading envelope edge is oriented precisely in relation to a direction transverse to the inserting direction of the inserting station; and an envelope-advancing arrangement for conveying the envelopes further once enclosures or sets of enclosures have been inserted, wherein the angle stop arrangement has a conveying nip between a top strand of an intermittently driven conveying belt of the envelope-advancing arrangement and a pressure-exerting roller which is pre-stressed against the top strand of said conveying belt, and in that, following the pressure-exerting roller in an advancing direction, interacting with the intermittently driven top strand of the conveying belt of the envelope-advancing arrangement is a roller bar which is controlled to be moved intermittently up and down and extends above the conveying belt of the envelope-advancing arrangement at least over a region in front of the inserting station, as seen in the conveying direction.

2. An envelope-filling station according to claim 1 wherein the intermediate conveying arrangement is configured such that it can be driven continuously.

3. An envelope-filling station according to claim 1 wherein the conveying belts of the envelope-feeding arrangement and/or the conveying belts of the intermediate envelope-conveying arrangement are formed by perforated belts guided over vacuum chambers, and a vacuum of the vacuum chambers being adjusted in steps along the conveying direction of the conveying belts.

4. An envelope-filling station according to claim 2 wherein the conveying belts of the envelope-feeding arrangement and/or the conveying belts of the intermediate envelope-conveying arrangement are formed by perforated belts guided over vacuum chambers, and a vacuum of the vacuum chambers being adjusted in steps along the conveying direction of the conveying belts.

* * * * *